US009088079B2

(12) United States Patent
Kumakura et al.

(10) Patent No.: US 9,088,079 B2
(45) Date of Patent: Jul. 21, 2015

(54) CRIMPED TERMINAL ATTACHED ELECTRIC WIRE AND METHOD OF CRIMPING CRIMPED TERMINAL TO ELECTRIC WIRE

(71) Applicant: YAZAKI CORPORATION, Tokyo (JP)

(72) Inventors: Hideto Kumakura, Shizuoka (JP); Takahito Nakashima, Aichi (JP); Hiroshi Kobayashi, Aichi (JP); Saori Yamazaki, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 136 days.

(21) Appl. No.: 13/835,546

(22) Filed: Mar. 15, 2013

(65) Prior Publication Data

US 2013/0252489 A1 Sep. 26, 2013

(30) Foreign Application Priority Data

Mar. 21, 2012 (JP) ..... 2012-063177

(51) Int. Cl.

| | |
|---|---|
| ***H01R 4/00*** | (2006.01) |
| ***H01R 4/18*** | (2006.01) |
| ***H01R 4/10*** | (2006.01) |
| ***H01R 43/048*** | (2006.01) |

(52) U.S. Cl.

CPC .. *H01R 4/18* (2013.01); *H01R 4/10* (2013.01); *H01R 4/185* (2013.01); *H01R 43/048* (2013.01); *Y10T 29/49185* (2015.01)

(58) Field of Classification Search

USPC ..... 439/878, 203, 459, 496, 425, 430, 442, 439/607.48, 607.5, 741, 877; 174/78, 84 R; 29/861, 863

See application file for complete search history.

(56) References Cited

U.S. PATENT DOCUMENTS

| | | | | |
|---|---|---|---|---|
| 5,239,749 | A * | 8/1993 | Fujimaki et al. | 29/877 |
| 6,942,529 | B2 * | 9/2005 | Fujimoto et al. | 439/886 |
| 7,985,923 | B2 * | 7/2011 | Yagi et al. | 174/84 R |
| 2002/0058447 | A1 * | 5/2002 | Endo et al. | 439/878 |
| 2008/0283268 | A1 * | 11/2008 | Iwasaki et al. | 174/78 |
| 2009/0269970 | A1 * | 10/2009 | Kumakura | 439/421 |
| 2011/0094797 | A1 | 4/2011 | Otsuka et al. | |

FOREIGN PATENT DOCUMENTS

| | | | |
|---|---|---|---|
| CN | 102089940 | A | 6/2011 |
| JP | 2010-97781 | A | 4/2010 |

OTHER PUBLICATIONS

Chinese Office Action and the Search Report for the related Chinese Patent Application No. 201310091791.9 dated Feb. 4, 2015.

* cited by examiner

*Primary Examiner* — Abdullah Riyami
*Assistant Examiner* — Harshad Patel
(74) *Attorney, Agent, or Firm* — Kenealy Vaidya LLP

(57) ABSTRACT

A crimped terminal attached electric wire comprising an electric wire, which is made by covering a conductor part with an insulative coating, and a crimped terminal including a conductor crimping part which is crimped to the conductor part when a pair of crimping strip parts form a joint along the extending direction of the conductor part, wherein the conductor crimping part is swelled in a direction perpendicular to the extending direction of the conductor part, and is formed into a barrel form while the joint is the only joint, when the conductor crimping part is crimped to the conductor part.

3 Claims, 9 Drawing Sheets

CRIMPED TERMINAL ATTACHED ELECTRIC WIRE AND METHOD OF CRIMPING CRIMPED TERMINAL TO ELECTRIC WIRE

TECHNICAL FIELD

The present invention relates to a crimped terminal attached electric wire which has an electric wire, which is made by covering a conductor part with an insulative coating, and a crimped terminal including a conductor crimping part which is crimped to the conductor part, and a method of crimping the crimped terminal to the electric wire.

BACKGROUND ART

Traditionally, there is a crimped terminal attached electric wire which has an electric wire, which is made by covering a conductor part with an insulative coating, and a crimped terminal including a conductor crimping part which is crimped to the conductor part when a pair of crimping strip parts form a joint along the extending direction of the conductor part. In such a crimped terminal attached electric wire, the conductor crimping part of the crimped terminal, which becomes a part that is crimped to the conductor part, and the conductor part are expanded in the extending direction of the conductor part due to the load for crimping. Since the expanding amount of the conductor crimping part is different from that of the conductor part, when, for example, insulative or conductive material is applied to the crimping part to ensure the connection stability, it is necessary to stabilize the position of the conductor crimping part relative to the conductor part in the extending direction of the conductor part after the conductor crimping part has been crimped to the conductor part.

To solve such a problem, a crimped terminal attached electric wire is proposed, for example, in a patent document 1 in which wire barrel strips (conductor crimping parts) are separately formed in the extending direction of the conductor part to control the expanding of the wire barrel strips.

In the crimped terminal attached electric wire described in the patent document 1, a strong crimping part, which is crimped with a high pressure to be highly compressed, is formed at the front side of a cut portion among the wire barrel strips by a first step, and a weak crimping part, which is crimped with a low pressure to be lowly compressed, is formed at the back side of the cut portion among the wire barrel strips by a second step.

CITATION LIST

Patent Document

[Patent document 1] Japan Patent Publication No. 2010-97781

SUMMARY OF INVENTION

Technical Problem

However, in the crimped terminal attached electric wire described in the patent document 1, because the cut portion for separating the wire barrel strips is formed, the strength of the wire barrel strips is decreased, and, as a result, the connection stability of the crimped terminal and the conductor part might decrease.

The present invention is made in view of the above situation, and the object of the present invention is to provide a crimped terminal attached electric wire and a method of crimping a crimped terminal to an electric wire so that a decrease of the connection stability of the crimped terminal and the electric wire can be prevented.

Solution to Problem

It is therefore a first aspect of the invention to provide a crimped terminal attached electric wire comprising: an electric wire, which is made by covering a conductor part with an insulative coating; and a crimped terminal including a conductor crimping part which is crimped to the conductor part when a pair of crimping strip parts form a joint along the extending direction of the conductor part, wherein the conductor crimping part is swelled in a direction perpendicular to the extending direction of the conductor part, and is formed into a barrel form while the joint is the only joint, when the conductor crimping part is crimped to the conductor part.

It is a second aspect of the invention to provide a method of crimping a crimped terminal to an electric wire, the crimped terminal attached electric wire comprising: the electric wire, which is made by covering a conductor part with an insulative coating; and the crimped terminal including a conductor crimping part which is crimped to the conductor part when a pair of crimping strip parts form a joint along the extending direction of the conductor part, including a crimping step in which the conductor crimping part is swelled in the direction perpendicular to the extending direction of the conductor part, and is crimped into a barrel form while the joint is the only joint.

It is a third aspect of the invention to provide a method of crimping the crimped terminal to the electric wire, wherein the crimping in the crimping step is the only crimping to complete the conductor crimping part crimped to the conductor part.

Advantageous Effects of the Invention

For the crimped terminal attached electric wire according to the first aspect of the present invention, when the conductor crimping part is crimped to the conductor part, the conductor crimping part is swelled in the direction perpendicular to the extending direction of the conductor part, and is formed into a barrel form while the joint is the only joint. Therefore, since the conductor crimping part and the conductor part are expanded in the direction perpendicular to the extending direction of the conductor part, the expanding quantities of the conductor crimping part and the conductor part in the extending direction are prevented, and the position of the conductor crimping part relative to the conductor part in the extending direction of the conductor part is stabilized. Besides, since the necessary portion where the joint is formed is limited to a minimum, a decrease of the strength is prevented. As a result, a decrease of the connection stability of the crimped terminal and the electric wire can be prevented.

The method of crimping the crimped terminal to the electric wire according to the second aspect of the present invention includes a crimping step in which the conductor crimping part is swelled in the direction perpendicular to the extending direction of the conductor part, and is crimped into a barrel form while the joint is the only joint. Therefore, since the conductor crimping part and the conductor part are expanded in the direction perpendicular to the extending direction of the conductor part, the expanding quantities of the conductor crimping part and the conductor part in the extending direction are prevented, and the position of the conductor crimping part relative to the conductor part in the extending direction of the conductor part is stabilized. Besides, since the necessary portion where the joint is formed is limited to a minimum, a decrease of the strength is prevented. As a result, a decrease of the connection stability of the crimped terminal and the electric wire can be prevented.

With the method of crimping the crimped terminal to the electric wire according to the third aspect of the present invention, since the crimping of the conductor crimping part is completed by one crimping when the conductor crimping part is crimped to the conductor part, the number of crimping times can be prevented from increasing. Besides, the management of the molds becomes easy because the number of the molds for crimping can be prevented from increasing. Further, the variation of the shape after the conductor crimping part has been crimped can be reduced.

DESCRIPTION OF EMBODIMENTS

Preferred embodiments of crimped terminal attached electric wires and methods of crimping a crimped terminal to an electric wire according to the present invention will be described in detail with reference to the figures as follows.

[Embodiment]

Figure 1:
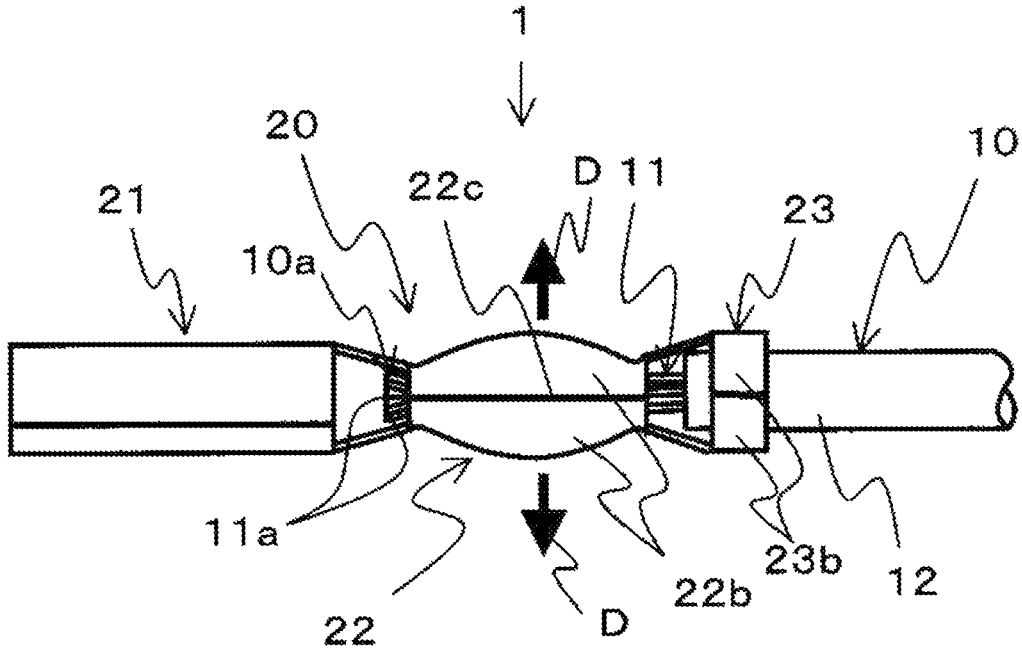
FIG. 1 is a top view of a crimped terminal attached electric wire according to an embodiment of the present invention.
Figure 2:
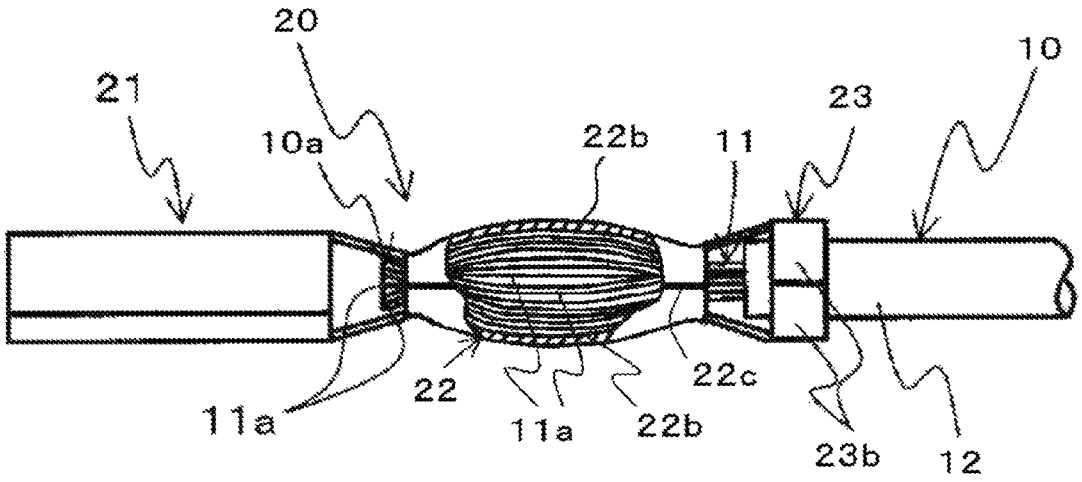
FIG. 2 is a top view which shows a section of part of the crimped terminal attached electric wire shown in FIG. 1.

FIG. 1 is a top view of a crimped terminal attached electric wire 1 according to an embodiment of the present invention. FIG. 2 is a top view which shows a section of part of the crimped terminal attached electric wire 1 shown in 1.

The crimped terminal attached electric wire 1 according to the embodiment of the present invention has an electric wire 10 which is made by covering a conductor part 11 with an insulative coating 12, and a crimped terminal 20 including a conductor crimping part 22 which is crimped to the conductor part 11 so that a pair of crimped strip parts 22*b* form a joint 22*c* along the extending direction of the conductor part 11.

First, the electric wire 10 is described.

The electric wire 10 is made by covering the conductor part 11, which is made by bundling a plurality of metal strands 10*a*, with the insulative coating 12.

The metal strands 10*a* are made of, for example, aluminum material, and a plurality of the metal strands 10*a* are bundled to function as the conductor part 11.

The insulative coating 12 is made of insulative materials such as synthetic resin, and protects the conductor part 11 so that the conductor part 11 can be insulated by being formed to cover the circumference of the conductor part 11.

The electric wire 10 is so formed that the crimped terminal 20 is connected to the conductor part 11 that is exposed by removing the insulative coating 12 at a terminal part 10*a* of the electric wire 10.

Next, the crimped terminal 20 is described.

The crimped terminal 20 is formed into a predetermined shape by forging with metal molds and bending a flat plate of, for example, copper alloy into the predetermined shape. The crimped terminal 20 is a female terminal, and has a mating connecting part 21 which becomes a part connecting with a mating connecting point not shown in the figure, a conductor crimping part 22 which is crimped to the exposed conductor part 11, and an insulative coating crimping part 23 which is crimped to the insulative coating 12 of the electric wire 10.

The mating connecting part 21 has a box-like shape, and an elastic contact strip not shown in the figure is formed inside the mating connecting part 21. The mating connecting part 21 is a part that is connected to a male terminal, which is not shown in the figure and becomes a mating connecting terminal, through the elastic contact strip.

The conductor crimping part 22 is formed between the mating connecting part 21 and the insulative coating crimping part 23, and is a part where the crimped terminal 20 and the conductor part 11 are connected. The conductor crimping part 22 has a base 22*a* including a wall that forms a bottom surface, and the pair of crimped strip parts 22*b* which are formed when two edges of the base 22*a* are raised into a strip form. The pair of crimped strip parts 22*b* are crimped to the conductor part 11 by being bent inwardly by using a jig for crimping.

An upper mold 30 to be described below and referred to as a crimper and a lower mold 40 referred to as an anvil are used as the jig for crimping, and the conductor crimping part 22 is crimped to the conductor part 11 when the conductor crimping part 22 is crushed by the upper mold 30 and the lower mold 40 into a predetermined shape.

When the conductor crimping part 22 is crimped to the conductor part 11, as shown with the arrows D in FIG. 1, the conductor crimping part 22 is swelled in a direction perpendicular to the extending direction of the conductor part 11, and is formed into a barrel form while the joint 22*c* is the only joint. That is, the conductor crimping part 22 is formed to be expanded in the direction perpendicular to the extending direction of the conductor part 11.

The conductor part 11 crimped by the conductor crimping part 22 follows the inside shape of the conductor crimping part 22, and is expanded in the direction perpendicular to the extending direction.

That is, since both the conductor crimping part 22 and the conductor part 11 are expanded in the direction perpendicular to the extending direction of the conductor part 11, the expanding amounts in the extending direction of the conductor part 11 are controlled.

Besides, since the necessary portion where the joint is formed is limited to a minimum, a decrease of the strength of the conductor crimping part 22 is prevented.

The insulative coating crimping part 23 forms an end opposite to the mating connecting part 21 of the crimped terminal 20, and is a part which holds the electric wire 10 by being crimped to the insulative coating 12. The insulative coating crimping part 23 has a base 23*a* which follows the base 22*a* of the conductor crimping part 22, and a pair of crimping strip parts 23*b* which are formed when two edges of the base 23*a* are raised. The pair of crimping strip parts 23*b* are crimped to the insulative coating 12 by being bent inwardly by using a jig for crimping not shown in the figure.

Figure 3A:
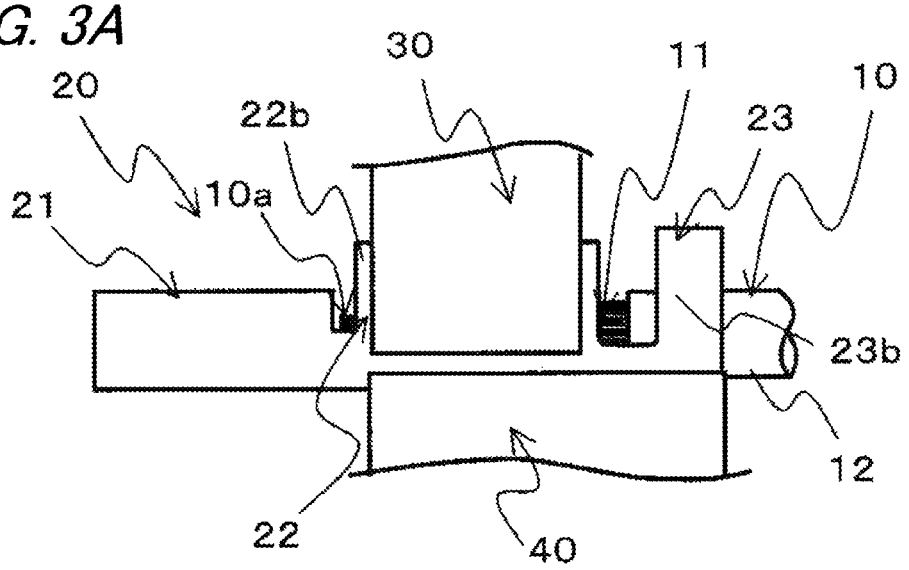
FIGS. 3A to 3C are figures showing a flow of steps of crimping the crimped terminal to the electric wire.
Figure 3B:
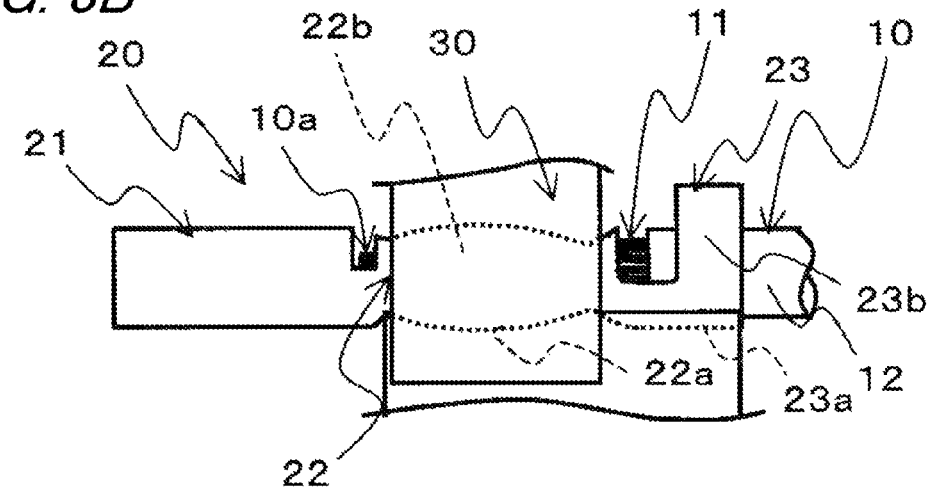
Figure 3C:
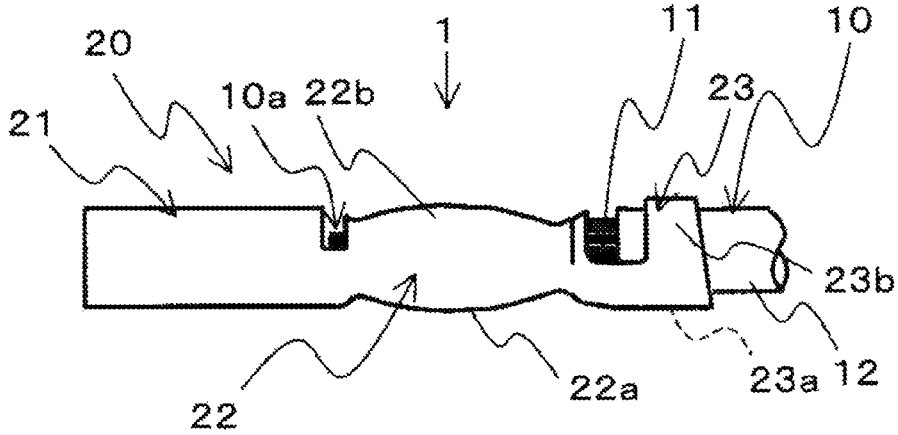
Figure 4A:
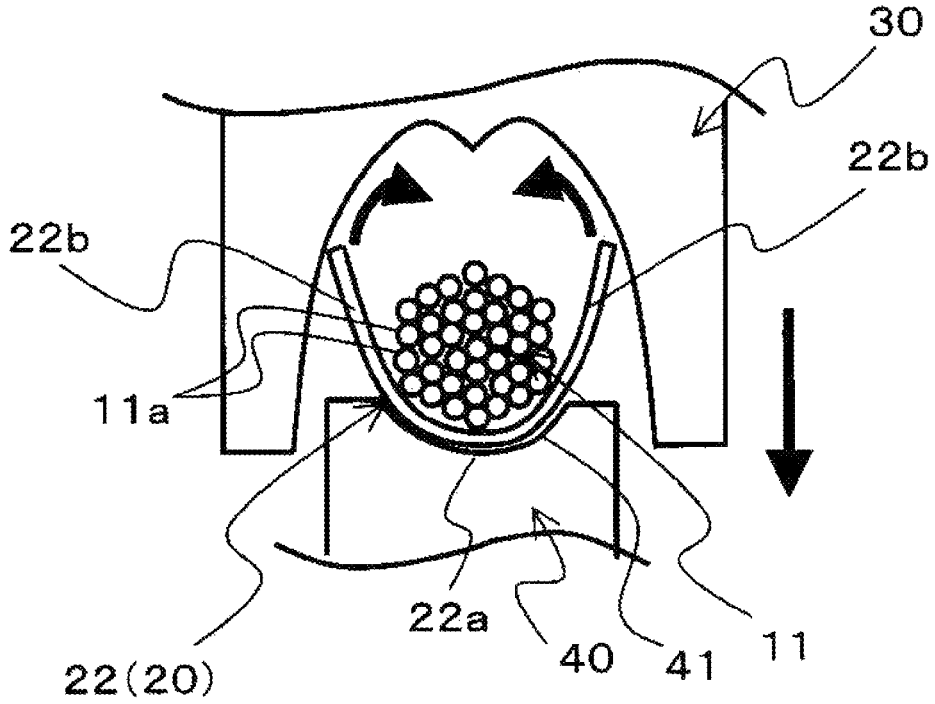
FIGS. 4A and 4B are figures showing the flow of the steps of crimping in FIGS. 3A to 3C by using a section perpendicular to the extending direction of a conductor part.
Figure 4B:
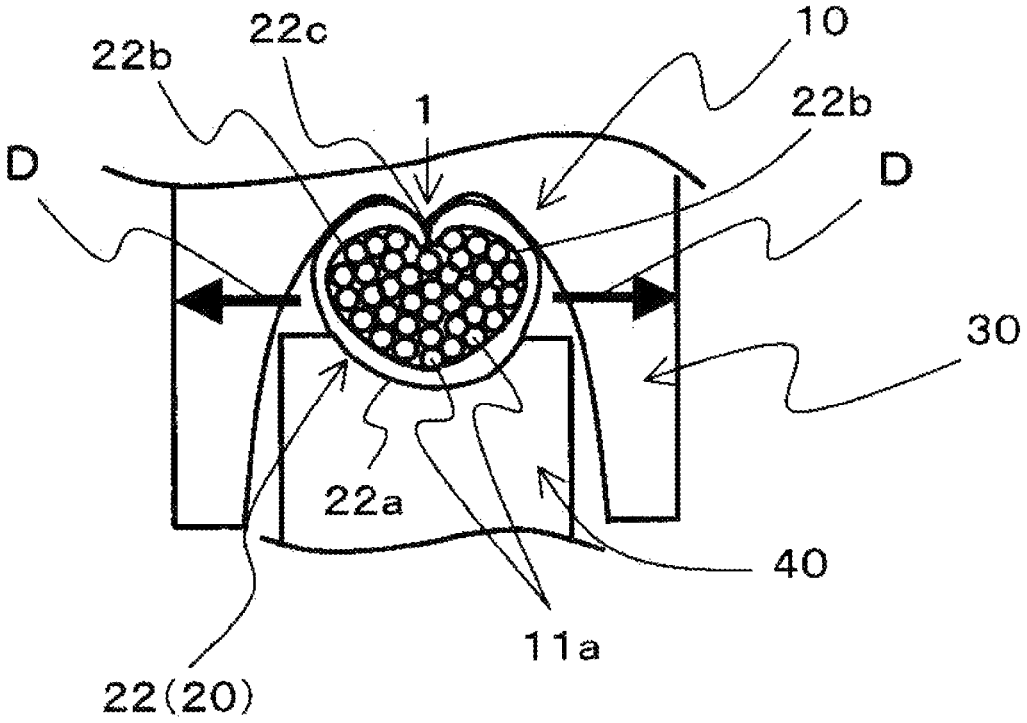
Figure 5:
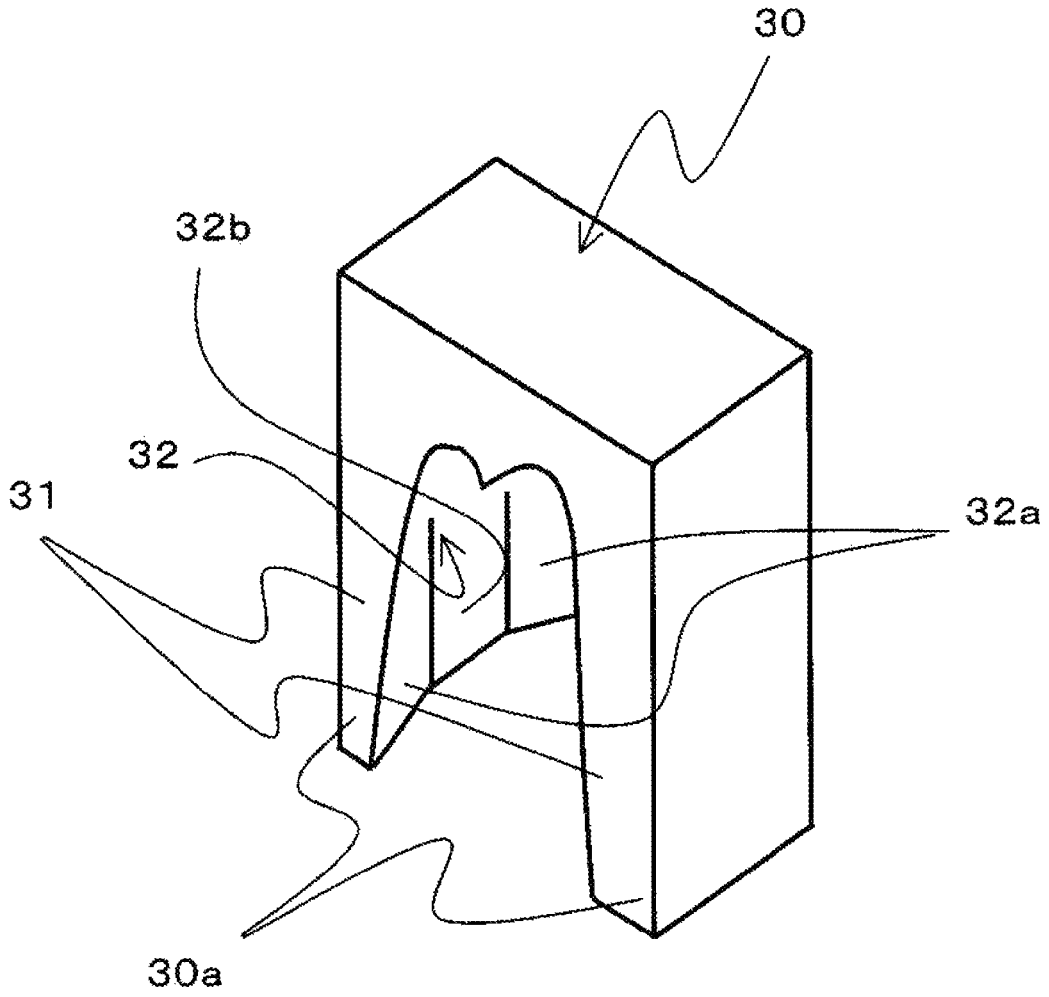
FIG. 5 is a perspective view of an upper mold shown in FIGS. 3A to 3C.
Figure 6:
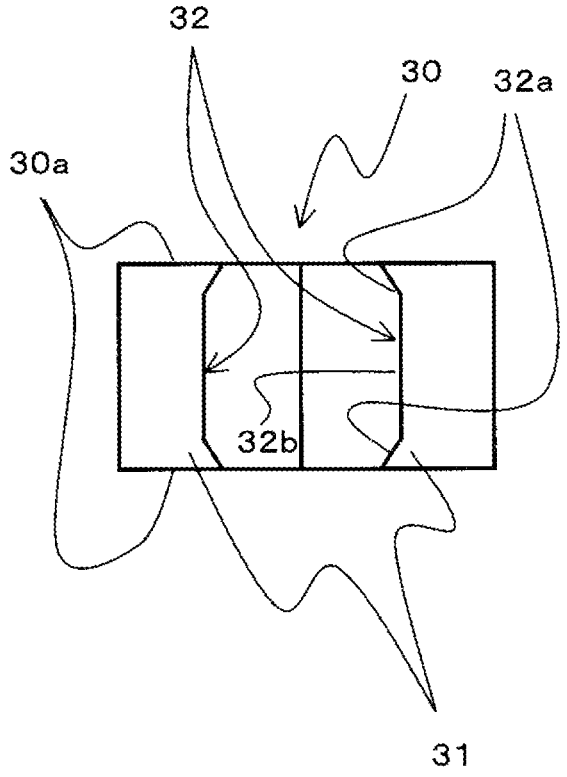
FIG. 6 is a figure, which is viewed from below, of the upper mold shown in FIG. 5.
Figure 7:
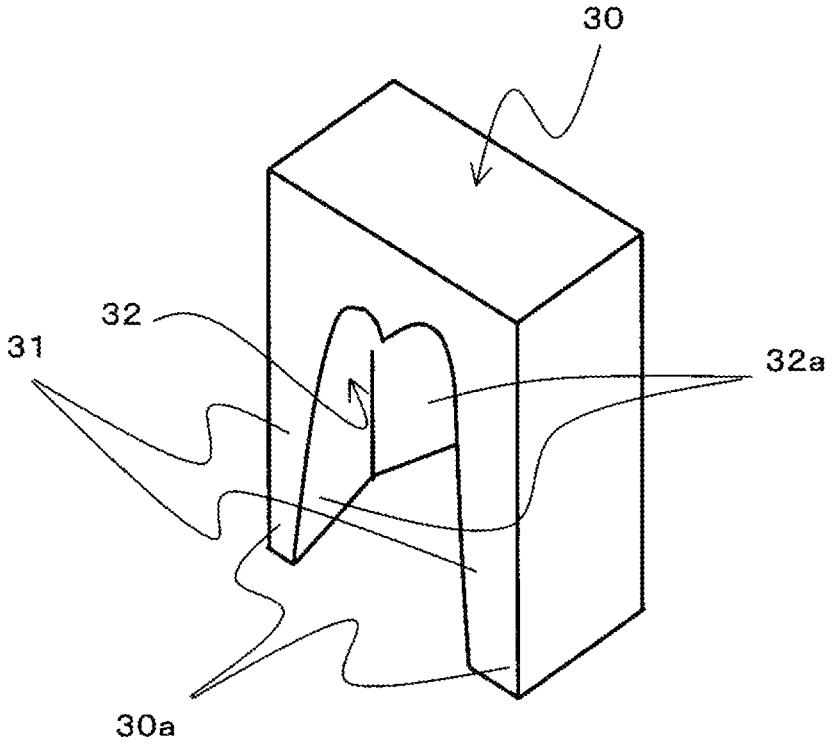
FIG. 7 is a perspective view which shows an upper mold which is a variation of the upper mold shown in FIG. 5.
Figure 8:
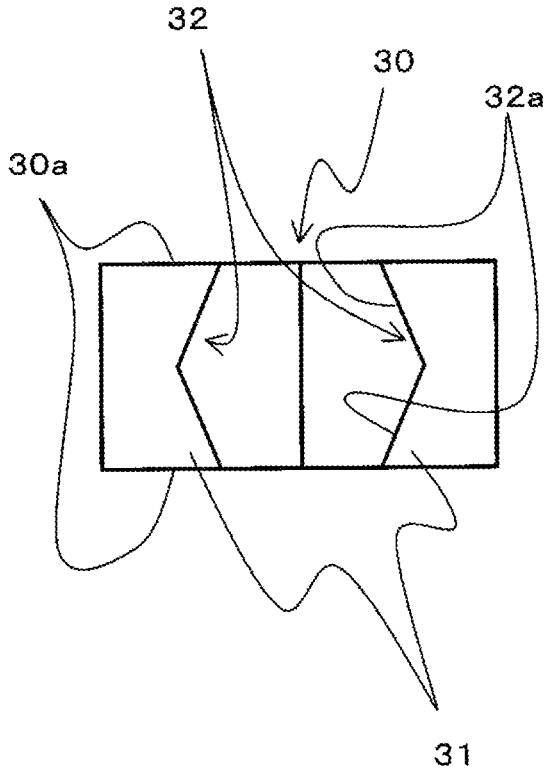
FIG. 8 is a figure, which is viewed from below, of the upper mold shown in FIG. 7.

Next, steps of crimping the crimped terminal 20 to the electric wire 10 are described by using FIGS. 3A to 6. FIGS. 3A to 3C are figures showing a flow of steps of crimping the crimped terminal 20 to the electric wire 10. FIGS. 4A and 4B are figures showing the flow of the steps of crimping in FIG. 3 by using a section perpendicular to the extending direction of the conductor part 11. FIG. 5 is a perspective view of the upper mold 30 shown in FIGS. 3A and 3B. FIG. 6 is a figure, which is viewed from below, of the upper mold 30 shown in FIG. 5. FIG. 7 is a perspective view which shows an upper mold which is a variation of the upper mold shown in FIG. 5. FIG. 8 is a figure, which is viewed from below, of the upper mold 30 shown in FIG. 7.

The operation of crimping the crimped terminal 20 to the electric wire 10 is performed by an operator who operates the upper mold 30 and the lower mold 40 by using, for example, a crimping device not shown in the figure.

Since the steps of crimping the crimped terminal 20 to the insulative coating 12 are typical crimping steps, the related explanation is omitted here.

First, the operator sets the crimped terminal 20 on the lower mold 40 when the conductor part 11 is carried on the bottom wall 22*a* of the crimped terminal 20, and makes the upper mold 30 drop from above the conductor crimping part 22 (refer to FIGS. 3A and 4A).

Below, the upper mold 30 and the lower mold 40 are described in detail.

As shown in FIGS. 5 and 6, the upper mold 30 has an arch shape which opens towards the lower mold 40, and the arch inside surface becomes guiding surfaces 32 for crushing the conductor crimping part 22 into a barrel form. The guiding surfaces 32 are so formed that the distance between a pair of arch foot parts 31 is enlarged in some areas. More specifically, as shown in FIG. 6, the guiding surface 32 has variable-distance guiding surface parts 32*a* which are slanted so that the distance between the arch foot parts 31 increases gradually from two end surfaces 30*a* of the upper mold 30 towards the inside, and a uniform-distance guiding surface 32*b* which is so provided that an area of a certain width in which the distance between the arch foot parts 31 becomes maximum is formed between the variable-distance guiding surface parts 32*a* between the two end surfaces 30*a*.

As shown in FIGS. 3A and 4A, the lower mold 40 has a generally cubical shape, and the top surface of the lower mold 40 on which the conductor crimping part 22 is carried becomes a curved guiding surface 41 for crushing the conductor crimping part 22 into a barrel form.

As shown in FIGS. 7 and 8, it is also possible that the upper mold 30 does not have the uniform-distance guiding surface 32*b*.

As such an upper mold 30 is dropped towards the lower mold 40 to sandwich the conductor part 11, the pair of crimping strip parts 22*b* of the conductor crimping parts 22 are bent to be slid on the guiding surfaces 32, the circumference of the conductor part 11 is enclosed into a barrel form and the joint 22*c* is formed along the extending direction of the conductor part 11.

Then, when the operator makes the upper mold 30 drop to the lowest position in the movement for crimping, the crimping is completed (refer to FIGS. 3B, 3C and 4B). Thereby, the conductor crimping part 22 is molded into a barrel form and is crimped to the conductor part 11. Thereby, the expansions of the conductor crimping part 22 and the conductor part 11 in the extending direction of conductor part 11 are converted into the expansions in the direction perpendicular to the extending direction of the conductor part 11. Since there is only one joint 22*c* in the conductor crimping part 22, the crimping of the conductor crimping part 22 is completed by one crimping.

For the crimped terminal attached electric wire 1 according to the embodiment of the present invention, when the conductor crimping part 22 is crimped to the conductor part 11, the conductor crimping part 22 is swelled in the direction perpendicular to the extending direction of the conductor part 11, and is formed into a barrel form while the joint 22*c* is the only joint. Therefore, since the conductor crimping part 22 and the conductor part 11 are expanded in the direction perpendicular to the extending direction of the conductor part 11, the expanding quantities of the conductor crimping part 22 and the conductor part 11 in the extending direction are prevented, and the position of the conductor crimping part 22 relative to the conductor part 11 in the extending direction of the conductor part 11 is stabilized. Besides, since the necessary portion where the joint 22*c* is formed is limited to a minimum, a decrease of the strength is prevented. As a result, a decrease of the connection stability of the crimped terminal 20 and the electric wire 10 can be prevented.

The method of crimping the crimped terminal to the electric wire according to the embodiment of the present invention includes a crimping step in which the conductor crimping part 22 is crimped to the conductor part 11 into a barrel form which assumes the axis of the conductor part 11 as an axis. Therefore, since the conductor crimping part 22 and the conductor part 11 are expanded in the direction perpendicular to the extending direction of the conductor part 11, the expanding quantities of the conductor crimping part 22 and the conductor part 11 in the extending direction are prevented, and the position of the conductor crimping part 22 relative to the conductor part 11 in the extending direction of the conductor part 11 is stabilized. As a result, the connection stability of the crimped terminal and the electric wire can be improved.

With the method of crimping the crimped terminal to the electric wire according to the embodiment of the present invention, since the crimping of the conductor crimping part 22 is completed by one crimping when the conductor crimping part 22 is crimped to the conductor part 11, the number of crimping times can be prevented from increasing. Besides, the management of the molds becomes easy because the number of the molds for crimping can be prevented from increasing. Further, the variation of the shape after the conductor crimping part 22 has been crimped can be reduced.

It is exemplified in the crimped terminal attached electric wire 1 and the method of crimping the crimped terminal to the electric wire according to the embodiment of the present invention that the conductor part 11 is made by bundling a plurality of metal strands 11*a*, but the invention is not limited to this and it is also possible that the conductor part 11 is made of a single core strand.

It is exemplified in the crimped terminal attached electric wire 1 and the method of crimping the crimped terminal to the electric wire according to the embodiment of the present invention that the crimped terminal 20 is a female terminal, but the invention is not limited to this and it is also possible to use other crimped terminals as long as the crimped terminal is crimped to the conductor part of the electric wire. For example, a male terminal may be used.

It is exemplified in the crimped terminal attached electric wire 1 and the method of crimping the crimped terminal to the electric wire according to the embodiment of the present invention that the insulative coating crimping part 23 is included, but the invention is not limited to this and it is also possible that the insulative coating crimping part 23 is not included.

Figure 9A:
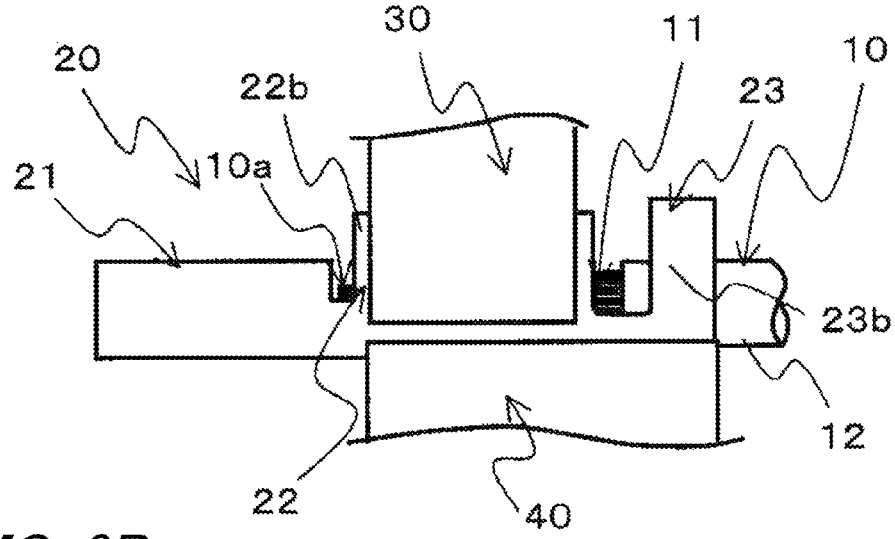
FIGS. 9A to 9C are figures showing a flow of steps of crimping the crimped terminal to the electric wire according to another example.
Figure 9B:
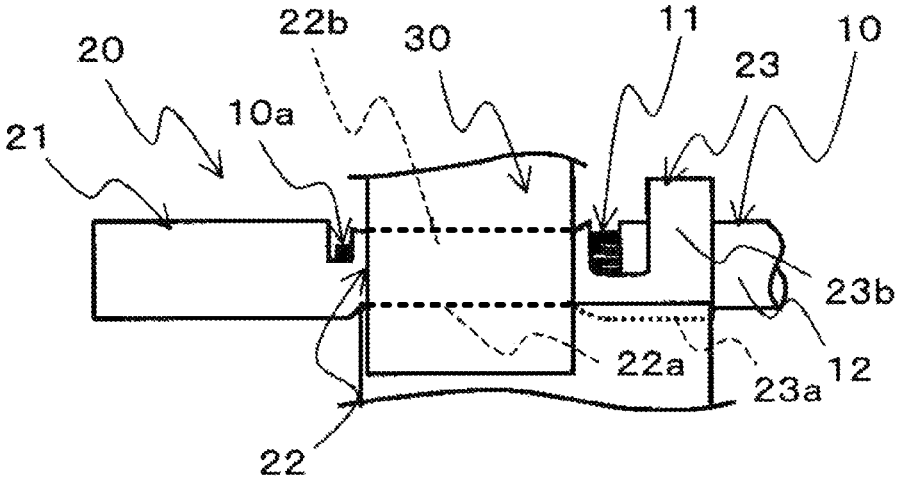
Figure 9C:
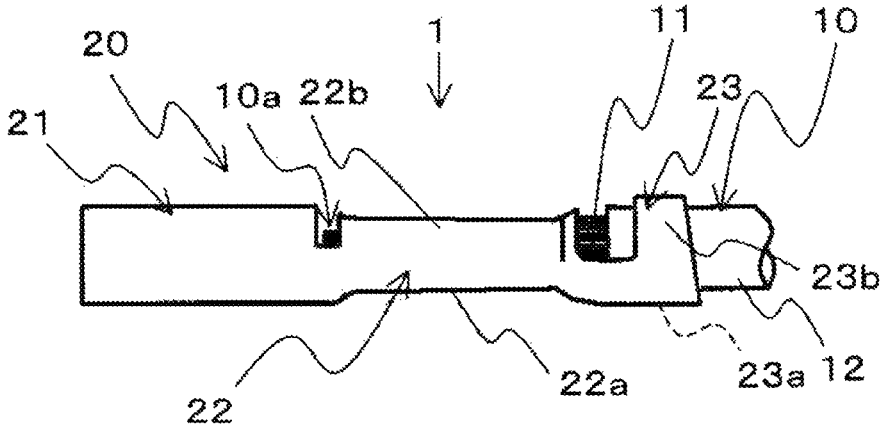

It is exemplified in the crimped terminal attached electric wire 1 and the method of crimping the crimped terminal to the electric wire according to the embodiment of the present invention that the conductor crimping part 22 is swelled in the directions perpendicular to the extending direction of the conductor part 11, and is formed into a barrel form in all directions perpendicular to the extending direction. However, the conductor crimping part 22 may not be swelled. One example is shown in FIG. 9. In this example, the conductor crimping part 22 is formed flatly and having a cylindrical shape. In this case, since the necessary portion where the joint is formed is limited to a minimum, a decrease of the strength is prevented.

The invention accomplished by the inventor is described in detail based on the above embodiment of the invention, but the present invention is not limited to the above embodiment and can be modified in various ways without departing from the spirit of the invention.

The invention claimed is:

1. A crimped terminal attached electric wire comprising:

an electric wire including a conductor part and an insulative coating covering the conductor part; and a crimped terminal including a conductor crimping part having a pair of crimping strip parts, the crimping part being crimped to the conductor part when the pair of crimping strip parts form a joint along an extending direction of the conductor part, wherein the conductor crimping part is swelled in a direction perpendicular to the extending direction of the conductor part, and is formed into a barrel form while the joint is the only joint, when the conductor crimping part is crimped to the conductor part, and the barrel form includes a pair of end portions and a center portion located between the two end portions, the end portions each have a width measured in the perpendicular direction, and the center portion has a width measured in the perpendicular direction that is greater than the width of each of the end portions.

2. A method of crimping a crimped terminal to an electric wire, the electric wire including a conductor part and an insulative coating covering the conductor part, and the crimped terminal including a conductor crimping part having a pair of crimping strip parts, the method comprising:

crimping the pair of crimping strip parts to form a joint along an extending direction of the conductor part and to swell the conductor crimping part in a direction perpendicular to the extending direction of the conductor part into a barrel form while the joint is the only joint, and the barrel form includes a pair of end portions and a center portion located between the two end portions, the end portions each have a width measured in the perpendicular direction, and the center portion has a width measured in the perpendicular direction that is greater than the width of each of the end portions.

3. The method of crimping the crimped terminal to the electric wire according to claim 2, wherein the crimping in the crimping step is the only crimping to complete the conductor crimping part crimped to the conductor part.

* * * * *